US006129505A

United States Patent [19]

Jupille et al.

[11] Patent Number: 6,129,505

[45] Date of Patent: Oct. 10, 2000

[54] STACKING TRAYS

[75] Inventors: Henry Jupille, Placerville; David James Tostenson, Auburn, both of Calif.

[73] Assignee: Jupille Design Incorporated, Montrose, Colo.

[21] Appl. No.: 09/169,035

[22] Filed: Oct. 8, 1998

Related U.S. Application Data

[63] Continuation of application No. 08/784,399, Jan. 17, 1997, Pat. No. 6,032,801, which is a continuation-in-part of application No. 08/892,811, Jul. 14, 1997, Pat. No. 5,816,406, which is a continuation of application No. 08/673,698, Jun. 25, 1996, abandoned.

[51] Int. Cl.[7] ..... B65G 57/16

[52] U.S. Cl. ..... 414/802; 206/509; 220/23.6; 414/788.2

[58] Field of Search ..... 206/504, 509; 220/23.6; 414/788.2, 788.3, 795.6, 801, 802

[56] References Cited

U.S. PATENT DOCUMENTS

| | | | |
|---|---|---|---|
| 1,112,943 | 10/1914 | Stone | 206/509 X |
| 3,734,309 | 5/1973 | Bateman | 206/509 X |
| 5,964,350 | 10/1999 | LaMarche et al. | 206/509 X |

FOREIGN PATENT DOCUMENTS

| | | | |
|---|---|---|---|
| 1 316 361 | 12/1962 | France | 206/509 |
| 26 45987 | 11/1977 | Germany | 206/509 |
| 1733340 | 5/1992 | U.S.S.R. | 206/509 |
| 1168468 | 10/1969 | United Kingdom | 220/23.6 |

*Primary Examiner*—Janice L. Krizek
*Attorney, Agent, or Firm*—Fish & Richardson P.C.

[57] ABSTRACT

Stackable trays and methods for stacking the trays are disclosed. A stackable tray has two side walls, each wall having a top channel along its top edge and a bottom channel along its bottom edge, each channel having an inner and an outer channel wall, where the width of two adjacent top channel outer channel walls is less than the width of the bottom channel, whereby two such top channel walls may slide into a bottom channel of a stackable tray of like kind, and where the width of two adjacent bottom channel outer channel walls is less than the width of the top channel, whereby two such bottom channel walls may slide into a top channel of a stackable tray of like kind.

2 Claims, 7 Drawing Sheets

STACKING TRAYS

This application is a continuation of U.S. Ser. No. 08/784,399, filed Jan. 17, 1997, now Pat. No. 6,032,801, which is a continuation-in-part of application No. 08/892,811 filed Jul. 14, 1997 now U.S. Pat. No. 5,816,406, which, is a continuation of U.S. Ser. No. 08/673,698, filed Jun. 25, 1996, now abandoned.

BACKGROUND

This invention relates to stackable trays and methods for stacking them, and in particular, to stackable shipping trays for eggs.

When shipping large quantities of loose or fragile products, such as eggs, the products may be shipped in trays or containers in order to provide support and protection from damage during shipment. Multiple trays are typically stacked onto shipping pallets and the whole may then be wrapped or otherwise constrained to keep the trays from falling off the pallet.

SUMMARY OF THE INVENTION

In general, in one aspect, the invention features a stackable tray having a tray bottom and two side walls joined to the tray bottom at opposite sides, each side wall having a top channel along its top edge and a bottom channel along its bottom edge, where the top and bottom edges are so configured that when two side walls of two such trays and their bottom edges are placed parallel and adjacent to each other, a portion of each such bottom edge may be received in the top channel of a side wall of a third tray of the invention.

Preferred embodiments of the invention include one or more of the following features. The side walls have supporting ribs providing support for weight carried by the side walls. The side walls have openings. The side walls are joined to the tray bottom so that when the tray rests on the bottom edges of the two side walls and a normal load is placed on the tray bottom, the two side walls are substantially parallel to each other. The tray bottom is joined to the side walls with fillets that minimize the flexural deflection between the tray bottom and the side walls. The side walls are joined to the tray bottom so that a plane of a side wall forms a precompensation angle with a plane of the tray bottom of about 3° off of perpendicular. The tray bottom has, or consists essentially of, egg holding cells. The side walls have openings that allow air to flow through the side walls and over the tray bottom with an aggregate width of at least 80% of the width of the side walls above the top of the tray bottom. The openings are of at least about 1,200 square millimeters and preferably of at least about 1,350 square millimeters to allow air to flow through the side walls and over the tray bottom. The tray is configured to carry a static load of at least about 170 kg (375 lbs). The bottom channel and the top channel of each side wall is a slotted track having exactly two channel walls. The tray is a single piece of polypropylene. The tray has means for horizontal interlocking.

In general, in another aspect, the invention features a pair of side walls for supporting a tray in a stacked configuration. Each side wall has a bottom edge that has a bottom channel running along it rigidly connected to a parallel top edge that has a top channel running along it, both channels having channel walls and the top channel being configured to receive one bottom channel wall of each of two adjacent left and right side walls of like kind so as to support the two adjacent left and right side walls.

In general, in another aspect, the invention features a stackable tray having two side walls, each side wall having a top channel along its top edge and a bottom channel along its bottom edge, each having an inner and an outer channel wall; where the width of two adjacent top channel outer channel walls is less than the width of the bottom channel, whereby two such top channel walls may slide into a bottom channel of a stackable tray of like kind; and where the width of two adjacent bottom channel outer channel walls is less than the width of the top channel, whereby two such bottom channel walls may slide into a top channel of a stackable tray of like kind. In one embodiment, the stackable tray is joined in an interlocked stack of stackable trays of like kind, with at least three layers of at least four of the stackable trays, each horizontally adjacent to two other trays in the same layer.

In general, in another aspect, the invention features a method of stacking trays having side walls. The method includes the steps of providing a first and a second tray; placing the two trays next to each other with side walls adjacent and parallel; providing a third tray and positioning it to have the same orientation of side walls as side walls of the first tray; and sliding the side walls of the third tray over the side walls of the first tray to engage both side walls of the first tray and one side wall of the second tray. In one embodiment, the method features providing a fourth tray and positioning it to have the same orientation of side walls as the side walls of the second tray; and sliding the side walls of the fourth tray over the side walls of the second tray to engage both side walls of the second tray and one side wall of the first tray.

In general, in another aspect, the invention features a method for removing trays from a self-supporting stack of trays of like kind. The method includes the step of sliding a tray off the top of the stack without lifting the tray off the stack. One preferred embodiment includes sliding all trays at the top of the self-supporting stack off the self-supporting stack simultaneously without lifting any of the trays off the self-supporting stack.

Among the advantages of embodiments of the invention are the following. The trays of the invention are light weight. The trays of the invention stack easily. The trays of the invention interlock horizontally and vertically with each other when stacked, and provide a monolithic structure when they are placed on a shipping pallet, for example, reducing or eliminating need for additional wrapping or retention on the pallet. The trays of the invention can be slid into place and do not have to be lowered into place. A stack of trays of the invention can be unstacked by sliding trays off the top without lifting. The egg trays of the invention can be used both for shipping and in an incubator, so that eggs do not need to be retrayed between shipping and incubation. The trays of the invention provide substantial openings allowing air to flow freely over the contents of the trays.

Other advantages and features will become apparent from the following description and from the claims.

DETAILED DESCRIPTION

Figure 1:
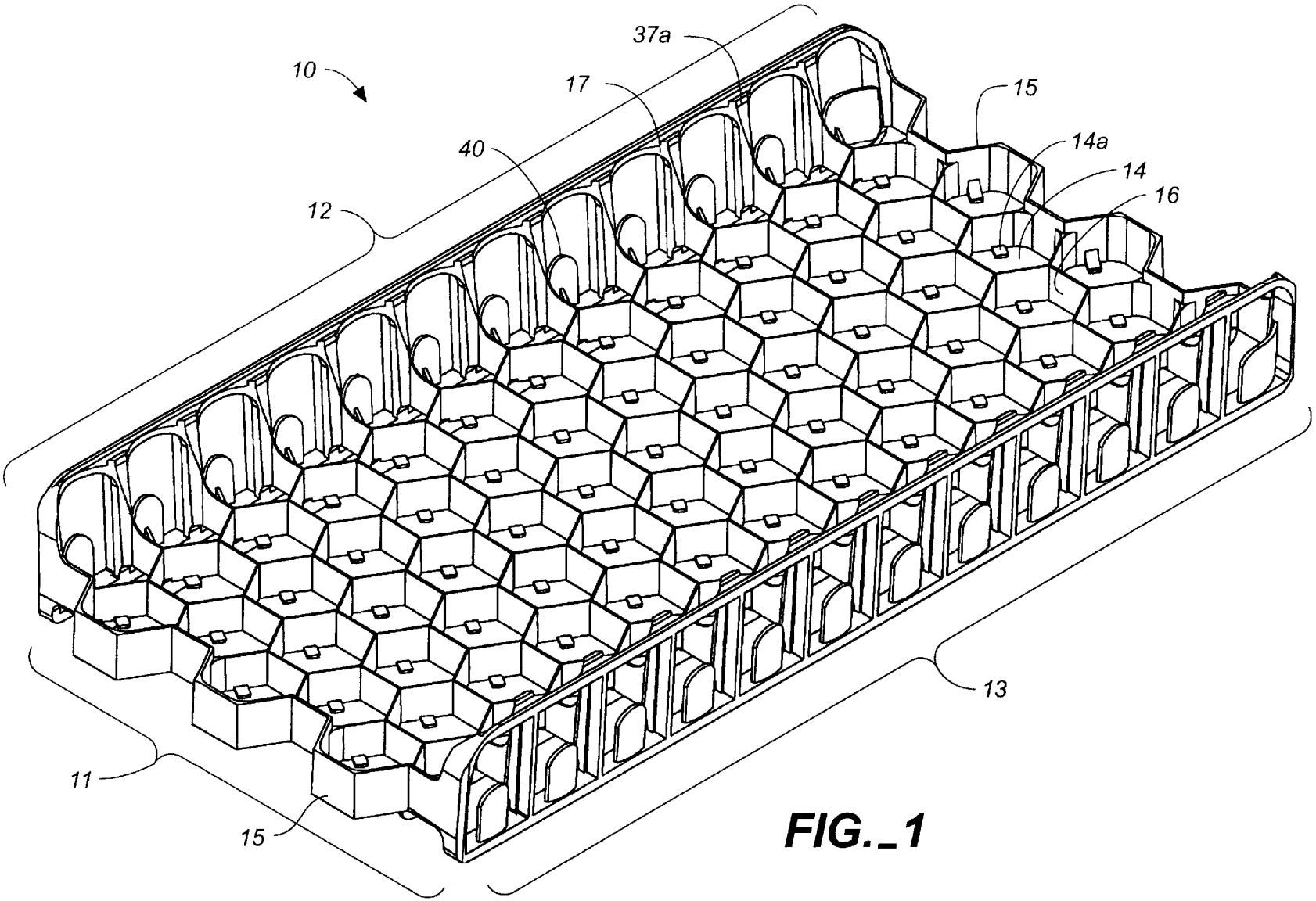
FIG. 1 is a top perspective view of a stackable egg tray.

Referring to FIG. 1, a stackable egg shipping tray 10 suitable for injection molding as a single piece has a horizontal tray bottom 11 integral to two vertical side walls 12 and 13 running a substantial length of the tray bottom 11. In an egg tray, multiple egg receiving receptacles 14 make up the tray bottom 11. A poultry egg (not shown) may be packaged for stacking, transport, or storage by inserting the egg into one of receptacles 14, which are arranged to hold eggs in an industry-standard honeycomb configuration. The egg tray specifically illustrated in the figures and described in detail here is suitable for use in an egg incubator such as the one described in U.S. Pat. No. 3,147,737.

Figure 2:
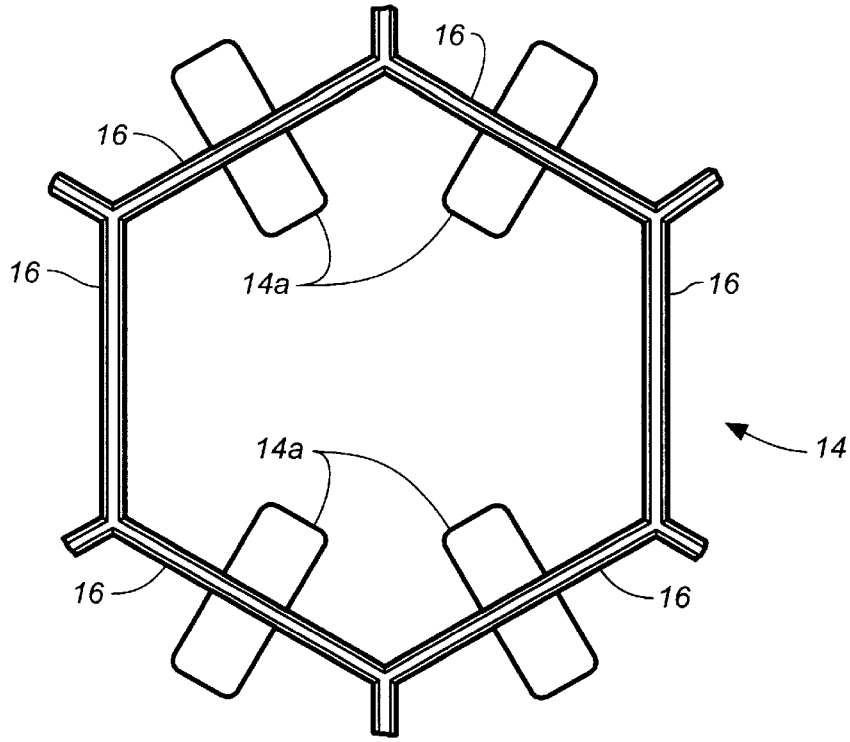
FIG. 2 is a top view of a egg holding cell or receptacle of the stackable egg tray.

Referring to FIG. 2, each egg receiving receptacle 14 is defined by a set of partitions 16 arranged to form a hexagonal cell to receive an egg and tabs 14*a* at the bottom of the cells to support the egg. The partitions that form a cell are integrally joined to each other and to the partitions of neighboring cells to form the tray bottom.

Figure 3:
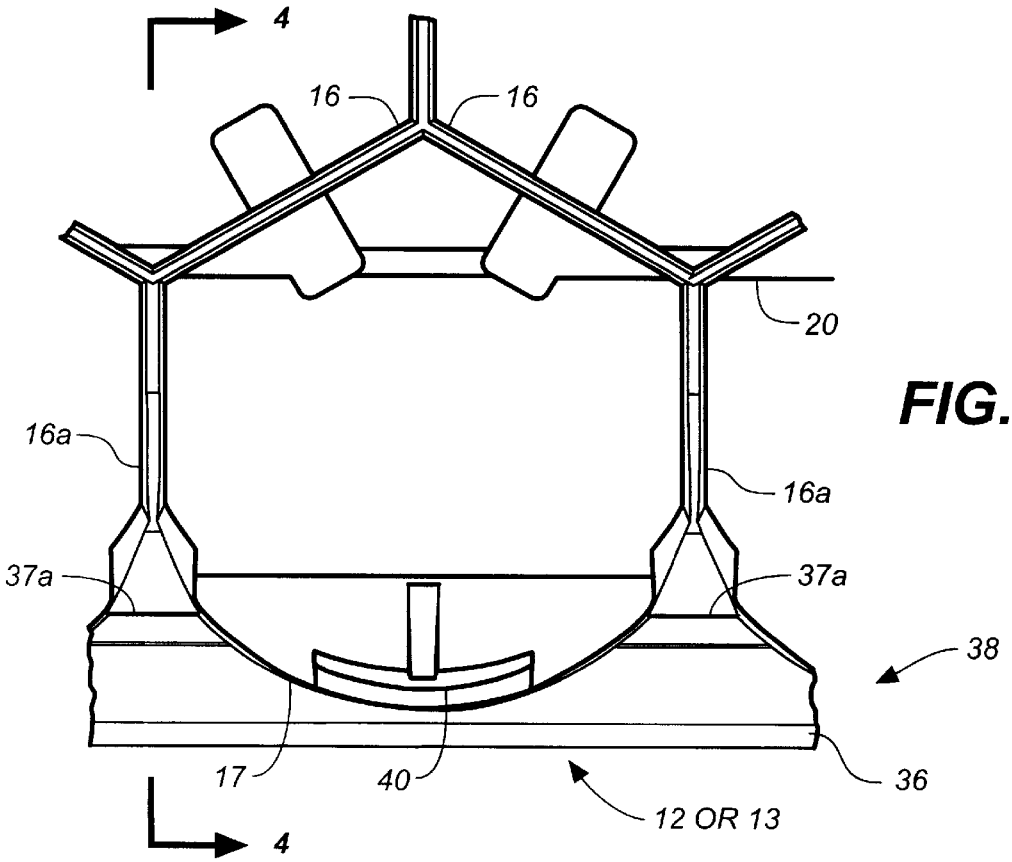
FIG. 3 is a top view of an egg cell adjoining a side wall.

Referring to FIG. 3, the receptacles adjacent to a side wall 12 or 13 omit two partitions 16 adjacent to the side wall and have instead an open arcuate partition wall 17 and a stay 40 integrated in the side wall 12 or 13 (see also FIG. 1).

Figure 4:
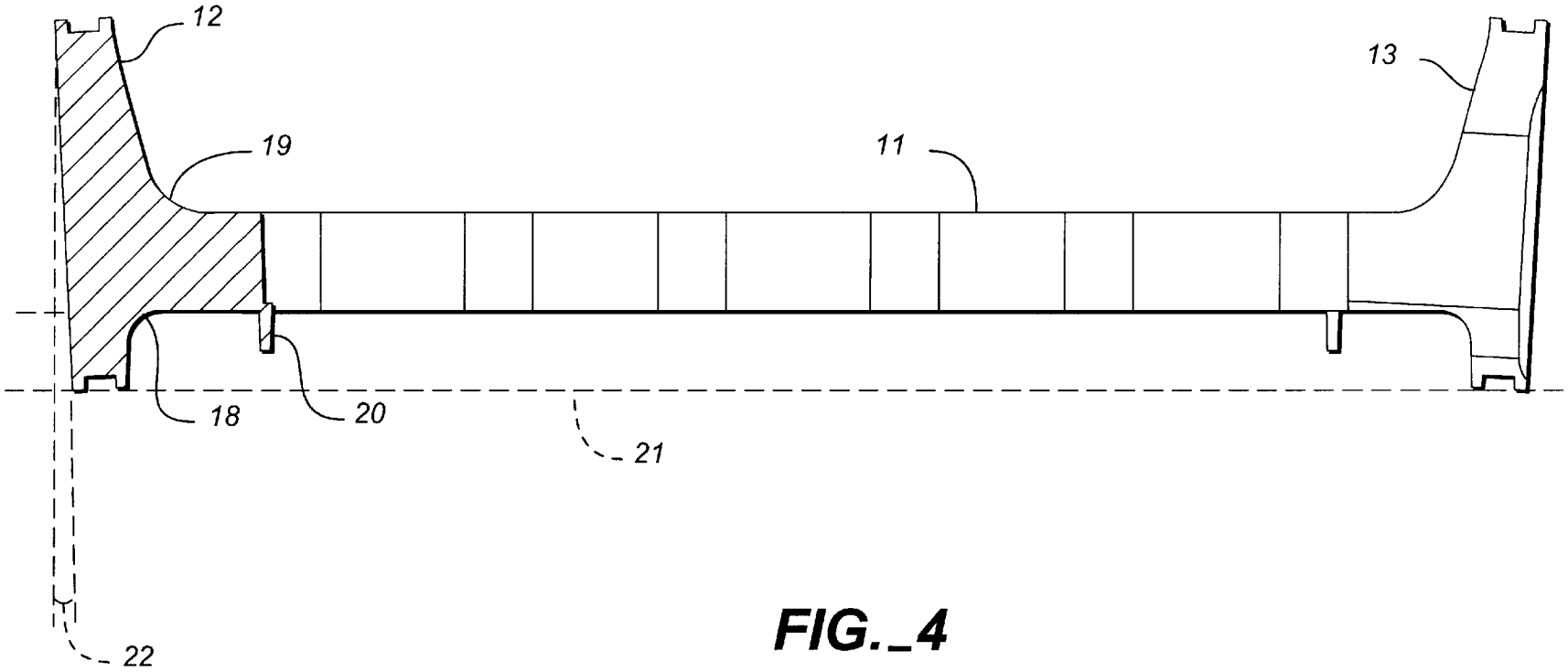
FIG. 4 is an end view of a cross section of the stackable egg tray showing in particular a cross section of a side wall.

Referring to FIG. 4, the tray bottom 11 is integral to two vertical supporting side walls 12 and 13. The tray bottom 11 may be offset about 16 millimeters (mm) above the bottom of walls 12 and 13 to provide clearance for eggs. When the tray is empty (as molded) and resting on a horizontal surface 21, the side walls 12 and 13 lean out from their bottom edge, as shown, at an angle 22 of about 3°. When the tray is loaded, the sag in the tray bottom 11 causes the side walls 12 and 13 to straighten up so that they are substantially vertical and can be joined as will be shown in FIG. 6A. The amount of sag, and thus the size of the precompensation angle 22, may be calculated or determined by experiment for particular applications.

Figure 5:
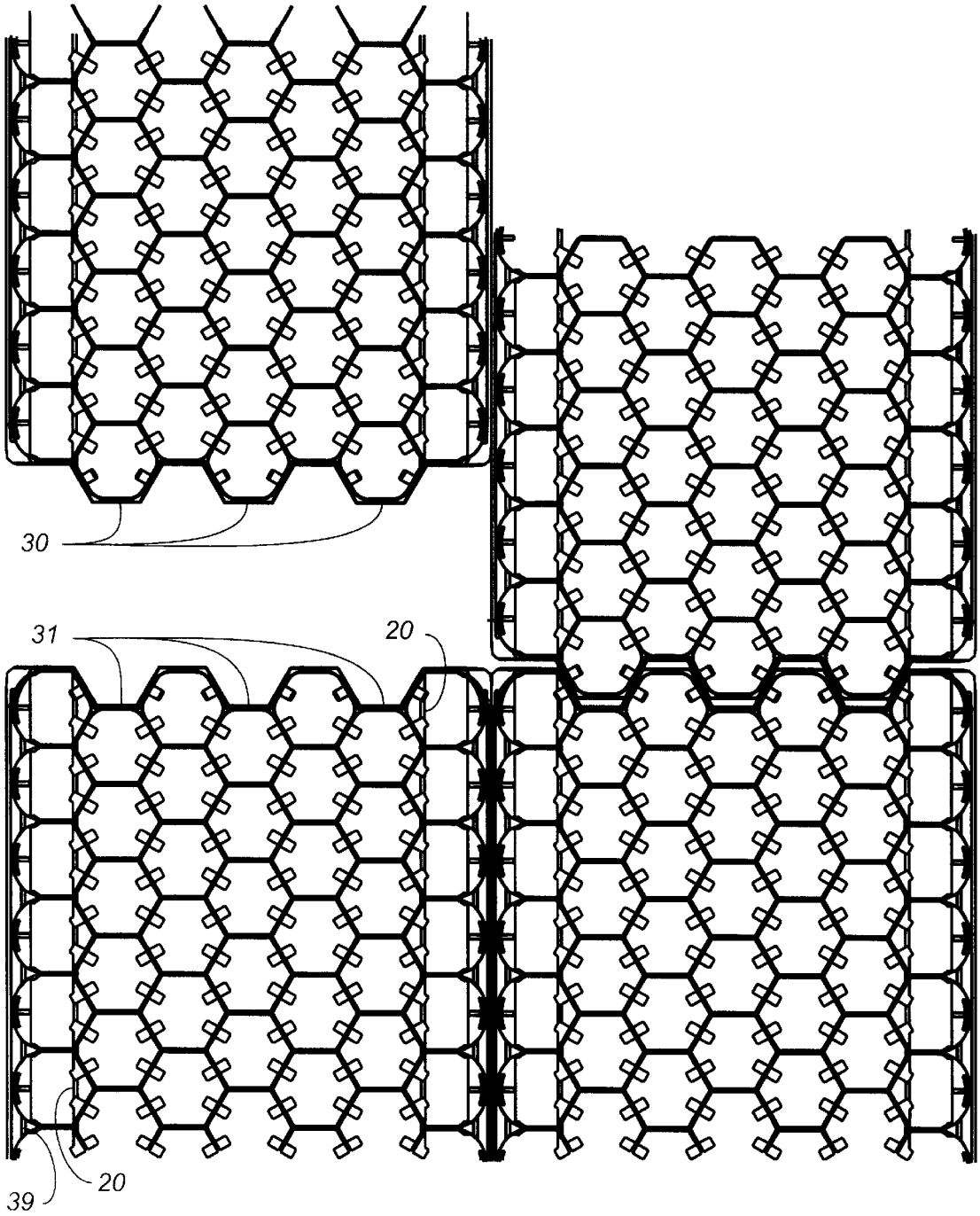
FIG. 5 is a top view of multiple stackable egg trays showing horizontal interlocking of trays.

Referring to FIG. 5, multiple trays may be arranged along one horizontal axis so that the extended cells 30 nest into the space created by the recessed cells 31 in the adjacent tray. Additional trays may be arranged along the other horizontal axis so that the vertical support walls 12 and 13 of adjacent trays meet as shown. This pattern may be extended and repeated as many times as desired along each horizontal axis.

Figure 6A:
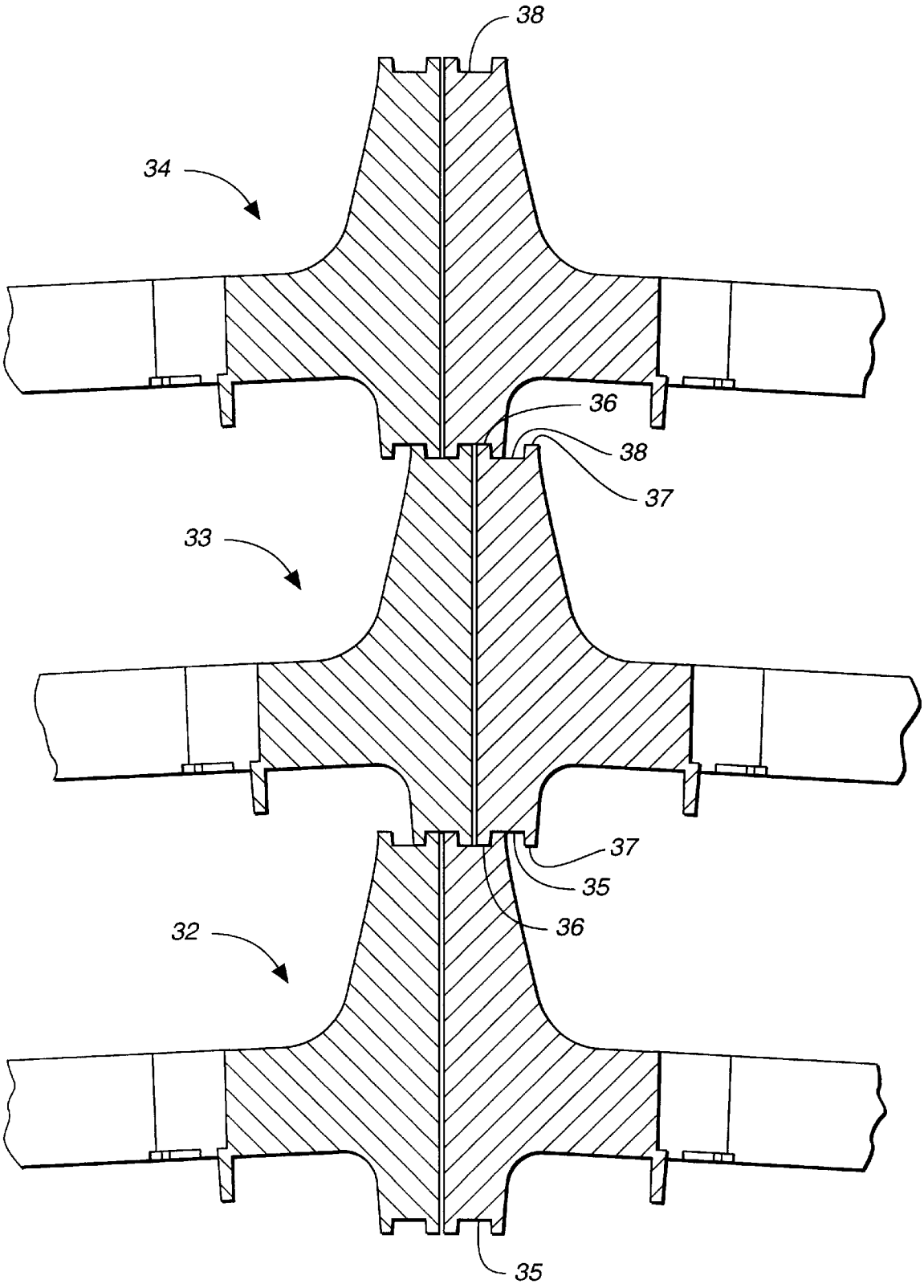
FIGS. 6A, 6B, and 6C are detailed cross section views of side walls of multiple stackable egg trays showing vertical stacking.
Figure 6B:
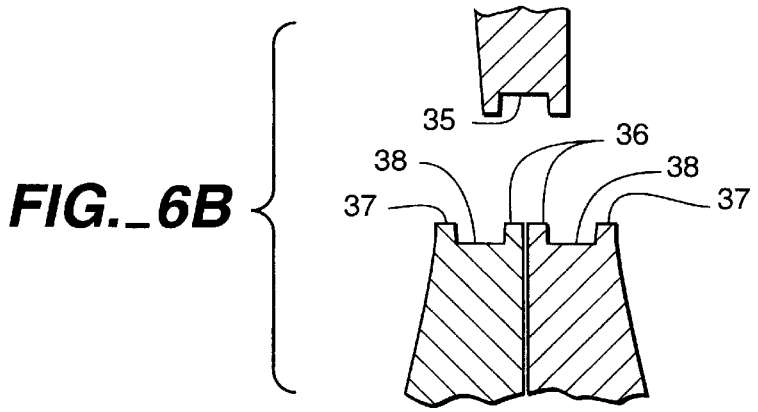

Referring to FIG. 6A and FIG. 6B, trays may be stacked in layers by sliding trays of an upper layer 33 or 34 onto the trays of the immediately lower layer 32 or 33, respectively, which are slightly offset from those of the immediately upper layer. A bottom channel 35 and a top channel 38 are found on the bottom and top, respectively, of the side walls of each tray. Each channel has an outer channel wall 36 and an inner channel wall 37. The channels and outer channel walls are sized so that an adjoining pair of outer channel walls fit into a complementary top or bottom channel, as shown in FIG. 6A. The inner channel walls may be wider, up to the width of the complementary channel. Referring to FIG. 3, the top inner channel wall, but not the top outer channel wall 36, is interrupted by the openings forming open arcuate partition walls 17. The pieces of the inner top channel wall are teeth 37*a* (also shown in FIG. 1) having a generally oval cross-section whose rounded ends prevent trays from catching on the teeth when they slide over each other.

To stack trays, they are positioned in such a way as to have an upper bottom channel straddle one or an adjacent pair of side walls of a lower top channel, as shown in FIG. 6A and FIG. 6B. For trays made with a non-negligible precompensation angle 22 (FIG. 4), the stacking illustrated in FIG. 6A is for loaded trays.

Each new layer of trays is added in the same manner, shifting successive layers first one way perpendicular to the side walls 12 and 13, and then the other, as shown in FIG. 6A. This and the interlocking of egg receiving receptacles in the other horizontal axis, shown in FIG. 5, combines the trays to form an integrated structure that can be placed, for example, on a shipping pallet as a monolithic structure with reduced need for wrapping or retention on the pallet.

Figure 6C:
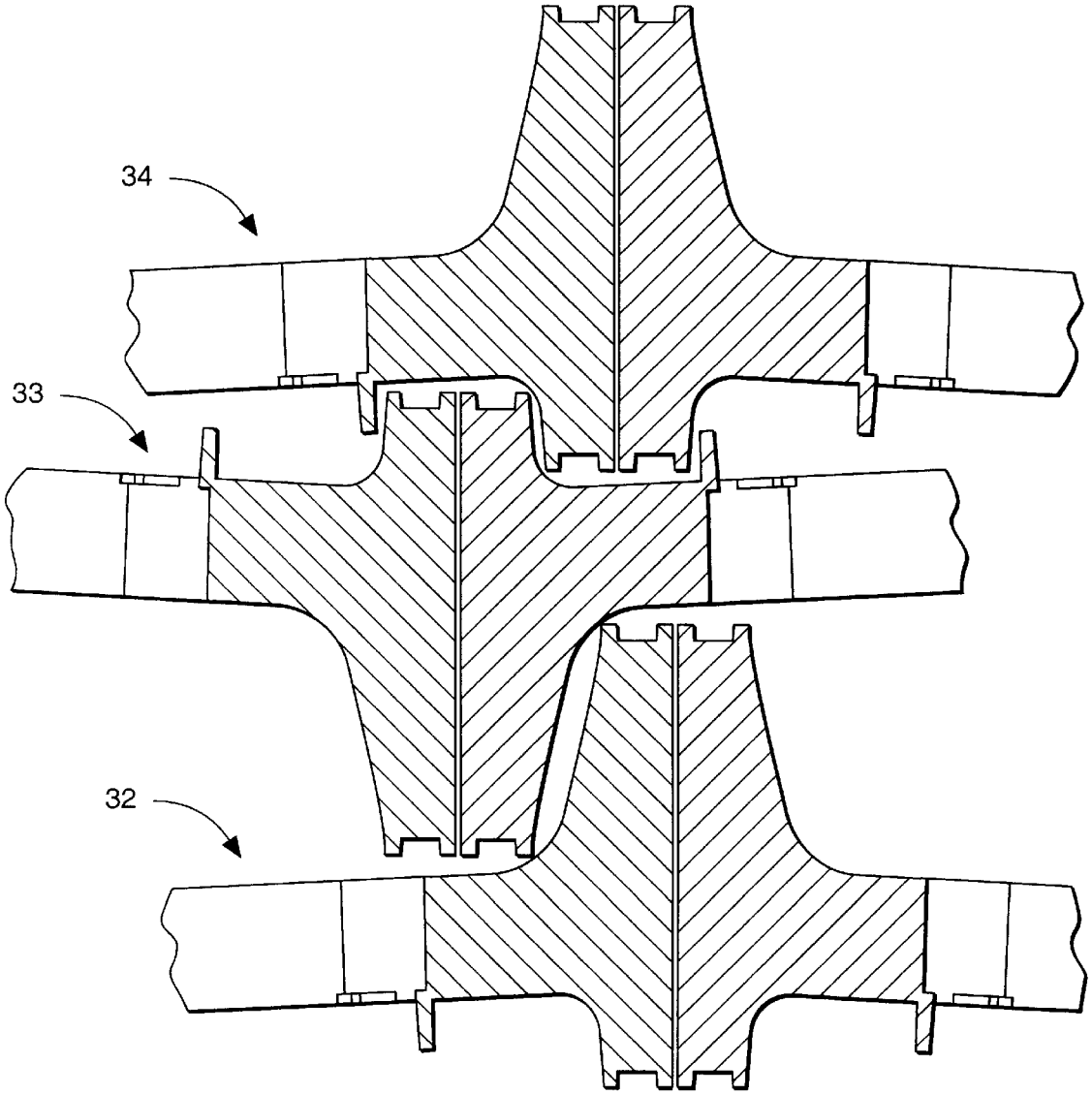

Referring to FIG. 6C, empty trays may be stacked in alternately inverted layers to reduce the space they take when stored or shipped, for example.

Figure 7:
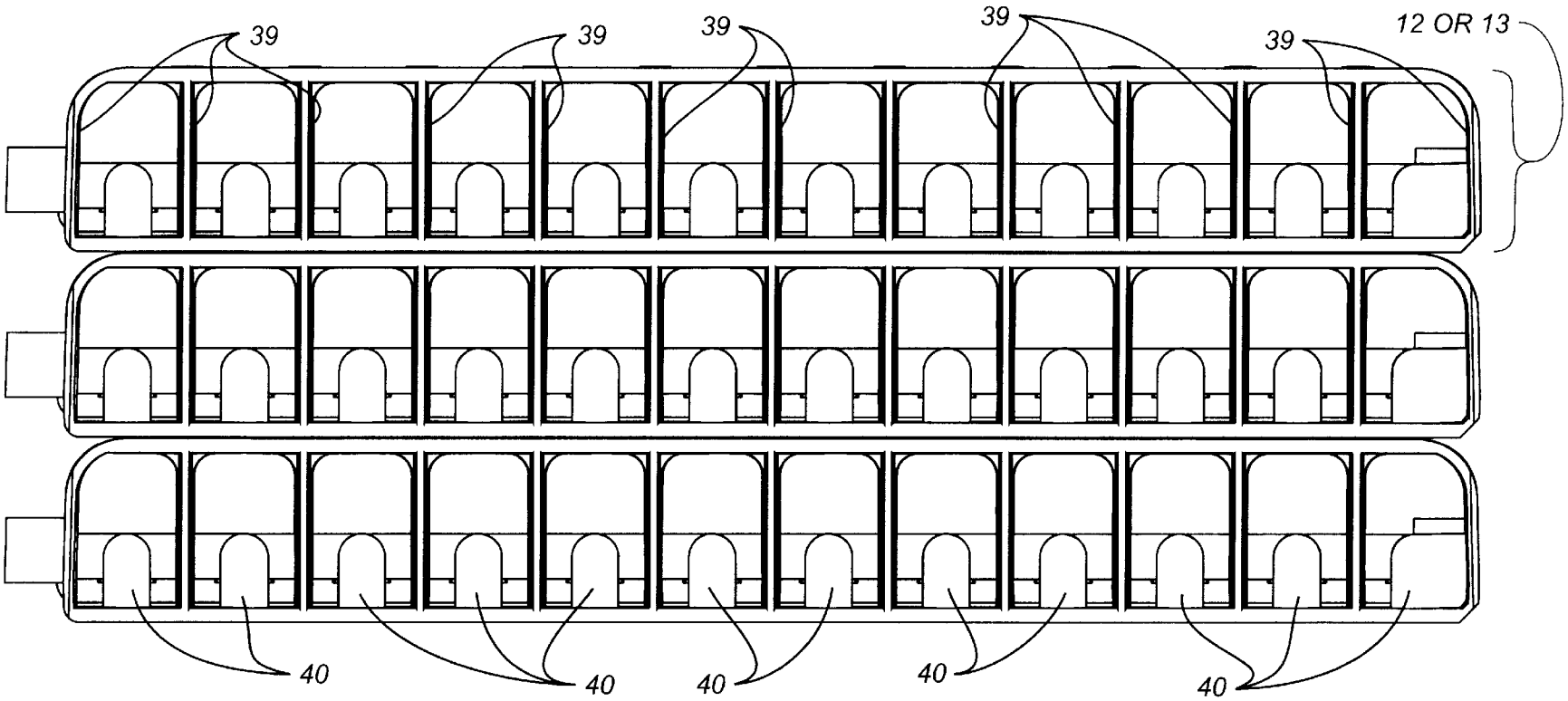
FIG. 7 is a side view of multiple stackable egg trays, stacked vertically.

Referring to FIG. 7, the stack height of stackable trays is limited only by the material and structural characteristics of the horizontal tray bottom and the side walls 12 and 13, which will now be described for one particular embodiment. The side walls 12 and 13 have ribs 39 (see also FIG. 5), which provide strength to carry and distribute the weight of loaded trays in a stack. Spaces between ribs 39 are partially filled by stays 40; the spaces allow air to circulate over the tray bottom and reduces the weight of the tray. The side walls 12 and 13 are of an average thickness of about 4 mm.

Referring to FIG. 2, each egg cell has a diameter of about 46 mm across the flats and is about 19 mm in height. The partitions 16 are about 2 mm thick. To provide stiffness, the partitions of the end walls 15 (FIG. 1) are somewhat higher, about 26 mm, and somewhat thicker, about 3 mm, than other partitions. The cells 14 adjacent to each of the side walls 12 and 13 are supported by a rail 20 (FIGS. 3, 4, and 5) running parallel to the side walls but not extending as far below the tray bottom as do the side walls. For the industry-standard configuration egg tray, the bottom of the rail 20 extends about 7 mm below the bottom of the tray bottom.

Referring to FIG. 4, the side walls are integral to the tray bottom with generous fillet radii 19 and 18 at the top and bottom of the side walls. The horizontal portions of the radii 19 and 18 are at the same height as, and extend to the tops and bottoms of, the adjoining partitions 16*a* (FIG. 3) or end walls 15 (FIG. 1), as the case may be.

Referring to FIG. 6A, the top and bottom channels 38 and 35 have an interior width of about 6 mm and a depth of about 3 mm. The outer and inner channel walls 36 and 37 have a width of about 2.5 mm and a height of 3 mm, matching the depth of the channels so that weight is distributed over adjoining top and bottom channel walls. The tops of the channel walls and the beds of the channels are substantially flat.

The egg tray specifically shown and described is manufactured as a single injection-molded piece of polypropylene, a material selected for its properties of chemical resistance or inertness. For manufacturing reasons, the partitions 16 and generally all other vertical elements of the tray have draft (taper) for ease in molding, which detail is not shown in the figures. With a polypropylene egg tray as shown in FIG. 1, the design stack height is about 1.67 meters (5½ feet) for 22 layers of loaded trays, and the empty tray weight is about 460 grams. With that many loaded egg trays, the tray on the bottom of the stack sees a static load of about 170 kg (375 lbs).

Referring to FIG. 7, the maximum width of interior ribs 39 (when seen from the side, as illustrated in FIG. 7) is about 6 mm. This leaves an area of about 43 mm by 32 mm above the top of a stay 40 and between a pair of ribs 39 through which air may flow above the level of the tops of interior partitions 16 (FIG. 1), which is the same level as the tops of stays 40. Thus, an airflow cross section of at least 1,200 $mm^2$ is provided, and preferably one of at least 1,350 $mm^2$, to provide openings for a substantially unobstructed flow through the side walls above the level of tops of the interior partitions.

Other embodiments are within the scope of following claims. For example, the tray bottom need not have individual partitions, cells or compartments for individual product items. Products including products other than eggs may be packaged for stacking, transport, or storage on shelves having a different pattern of receptacles, or no receptacles at all, according to the nature of the product. Horizontal interlocking may be created by tabs and sockets instead of recessed and extended cells. The tray may have more than two side walls, which may be joined to the tray bottom at different locations, and which need not extend the length of the tray. The tray may be constructed by different means of different materials and from more than one piece and more than one material, with the tray bottom being metal and attached supports being plastic, for example. Plastics providing other combinations of cost, strength and chemical inertness for particular applications include high-density polyethylene, nylon, ABS, and polycarbonate. The tray bottom and side walls need not have openings. The channel may be a slotted track or groove or a pair of grooves on the top edge or on both top and bottom edges of the side walls, or other forms of channel structure, including structures with a detent to inhibit vertical movement of an upper tray off of a lower one. The channel walls may be continuous or interrupted.

What is claimed is:

1. A method of stacking trays having side walls, the method comprising the steps of:

providing a first and a second tray;

placing the two trays next to each other with side walls adjacent and parallel;

providing a third tray and positioning it to have the same orientation of side walls as side walls of the first tray; and sliding the side walls of the third tray over the side walls of the first tray to engage both side walls of the first tray and one side wall of the second tray, the side walls of the third tray being reflections of each other through a vertical plane with reference to any features by which the side walls engage other sidewalls, whereby the third tray can be slid over the first and second trays beginning with either end of the third tray.

2. The method of claim 1, further comprising:

providing a fourth tray and positioning it to have the same orientation of side walls as the side walls of the second tray; and sliding the side walls of the fourth tray over the side walls of the second tray to engage both side walls of the second tray and one side wall of a fifth tray adjacent the second tray.

* * * * *